United States Patent [19]

Hedden et al.

[11] Patent Number: 4,627,174

[45] Date of Patent: Dec. 9, 1986

[54] PROCESS AND SYSTEM FOR THE DRY QUENCHING OF COKE

[75] Inventors: Kurt Hedden, Karlsruhe; Kurt-Günther Beck, Essen-Bredeney; Wolfgang Rohde; Horst Schumacher, both of Essen-Heisingen, all of Fed. Rep. of Germany

[73] Assignee: Bergwerksverband GmbH, Essen-Krey, Fed. Rep. of Germany

[21] Appl. No.: 725,048

[22] Filed: Apr. 19, 1985

Related U.S. Application Data

[63] Continuation-in-part of Ser. No. 462,901, Feb. 1, 1983, abandoned.

[30] Foreign Application Priority Data

Feb. 4, 1982 [DE] Fed. Rep. of Germany ..... 3203731
Feb. 4, 1982 [DE] Fed. Rep. of Germany ..... 3203732

[51] Int. Cl.[4] ..... F26B 3/16

[52] U.S. Cl. ..... 34/20; 34/168; 34/171; 34/211

[58] Field of Search ..... 201/39, 41; 202/227, 202/228; 34/169, 168, 20, 171, 211; 432/77

[56] References Cited

U.S. PATENT DOCUMENTS

| | | | |
|---|---|---|---|
| 1,145,772 | 7/1915 | Josey et al. | 34/20 |
| 1,854,407 | 4/1932 | Janeway, Jr. | 202/228 |
| 2,581,134 | 1/1952 | Odell | 34/168 |
| 4,288,294 | 9/1981 | Velling | 202/228 |

*Primary Examiner*—Larry I. Schwartz
*Attorney, Agent, or Firm*—Karl F. Ross; Herbert Dubno

[57] ABSTRACT

Glowing coke descending through a cooling duct in a coking plant is quenched by two gas flows respectively traversing an upper compartment and a lower compartment of the duct, the two compartments meeting at a restricted gate for the passage of the coke. At least the lower gas flow, passing in countercurrent to the descending coke charge, is also circulated through a drying and preheating oven for coal to be fed to a coke-oven battery of the plant, thus containing some water vapor. When the upper flow is also constituted by coal-drying gas, it is passed downward through the upper compartment in order to reduce the height of a high-temperature zone in which combustion and thus loss of coke could occur. The coke gate is formed by a funnel-shaped upper partition and an upwardly pointing conical lower partition between which a scavenger gas passes in cross-flow.

4 Claims, 6 Drawing Figures

PROCESS AND SYSTEM FOR THE DRY QUENCHING OF COKE

CROSS REFERENCE TO RELATED APPLICATION

This application is a continuation-in-part of Ser. No. 462,961, filed Feb. 1, 1983 now abandoned.

FIELD OF INVENTION

Our present invention relates to a process and a system for the so-called dry quenching of glowing coke in a coking plant. The term "dry quenching" connotes a process in which a gas is used as a cooling fluid, as distinct from a wet-quenching process where large quantities of water are utilized for that purpose.

BACKGROUND OF THE INVENTION

The quenching with a gas rather than with water is economically and ecologically advantageous since it avoids the venting of large amounts of steam into the atmosphere and since the gas, after cooling, can be recirculated. In fact, the sensible heat carried by the gas is available for other purposes in a coking plant, particularly for the preheating of a new batch of coal to be charged into a coking chamber. Conventionally, different gases are used for quenching the coke and for preheating and drying the "green" coal of the new charge, the two gases traveling in separate circuits linked by a heat exchanger.

The use of a separately circulating inert gas as a cooling fluid for the coke, coupled with the need for a heat exchanger, is inconvenient and rather cost-intensive. The thermal efficiency of such a system is low because of losses in both circuits and of the poor heat transfer between gases present on the primary and the secondary side of the heat exchanger. The utilization of a single gas for both purposes, on the other hand, creates problems since the water vapors generated in a coal-drying oven give rise to the formation of water gas which reacts with the hot charge to be quenched, with consequent combustion and loss of a significant amount of coke.

Thus, a one-circuit system described in German laid-open specification No. 24 15 758 includes a two-stage condenser wherein the water vapor entrained by the circulating gas is largely eliminated before that gas enters the lower end of a vertical quenching duct or bunker in which the hot coke descends in order to be cooled; the cooling gas, accordingly, traverses that duct in countercurrent to the coke mass.

Even in this system a heat exchanger is used in which the gas leaving the condenser cools the vapor-saturated drying gas enterng same; while this heat exchange expedites the removal of water in the condenser, it causes a not very desirable preheating of the gas reaching the quenching duct as a cooling fluid.

In order to reduce the reliance on a separately generated and correspondingly expensive inert gas in the quenching of glowing coke, it has further been proposed (German laid-open specification No. 30 00 808) to limit the use of such a gas to the lower part of a quenching duct and to pass a flue gas available from a coking chamber through the upper part of the duct forlowering the coke temperature to a point somewhat above 750° C.; the inert gas exiting from the lower part can then serve for the preheating and drying of coal.

The two gases traverse the respective parts of the quenching duct in countercurrent to the descending coke; conventional wisdom, in fact, dictates such countercurrent operations for both the cooling of the coke and the preheating and drying of the "green" coal. An exception to this rule is suggested in German laid-open specification No. 28 53 299 for the specific purpose of maintaining the temperature of the outflowing, heated cooling gas, utilized to operate a steam generator, in the event of a temporary interruption of the coke supply; by branching off part of the inflowing cooling gas from the main lower inlet of the duct to an ancillary upper inlet under these circumstances, that part of the gas is more highly heated so that the resulting mean temperature at the outlet is about the same as under normal operating conditions. Neither of the two last-mentioned German publications addresses the problem of preventing excessive coke losses through combustion due to the presence of water vapor in a gaseous cooling fluid.

OBJECTS OF THE INVENTION

The most significant object of the invention is to provide and improved method of and system for the combined drying and preheating of coking coal and dry cooling of coke whereby the sensible heat of the cooling gas can be abstracted directly from the hot coke and can be used directly for theprehating and drying without coke loss as a result, e.g. by burnoff or undesirable reactions.

An important object of our present invention, therefore, is to provide a coke-quenching process in which that problem is solved without the need for a condenser upstream of a cooling-gas inlet of a quenching duct.

A related object is to provide an improved process for the direct cooling of hot coke by a gas used for the preheating and drying of coal in one and the same plant.

A further object of our invention is to provide a coke-quenching duct particularly useful for the implementation of our improved process.

Still another object of our invention is to extend the principles of the above-identified copending application.

SUMMARY OF THE INVENTION

We have found, in accordance iwth our present invention, that wet gas from a coal-drying oven can be safely used as a cooling fluid in the lower part of a coke-quenching duct in which the coke temperature has been reduced to less than about 800° C. Thus, a feature of our invention resides in passing a first flow of cooling gas through an upper compartment of a quenching duct to reduce the temperature of the glowing coke, entering that compartment from above at a temperature higher than about 1100° C., to a range between substantially 700° and 800° C. and passing a second flow of cooling gas, this latter containing water vapor after traversing a drying and preheating apparatus or stage, through a lower compartment of the duct in countercurrent to the descending coke for further reducing its temperature to a level substantially below 300° C.

The gas serving to cool the incoming coke in the upper duct compartment may be of the conventionally used inert type without significant moisture content. The term "inert" as used with respect to the gas used to cool the coke in the upper duct compartment is intended to means that the cooling gas contains selectively no gasification medium. Pursuant to a more particular feature of our invention, however, we have further found that the same kind of wet gas from a coal-drying oven as used in the lower compartment can also be safely employed in the upper compartment, provided the gas enters the latter compartment near its top and moves codirectionally with the descending coke therethrough. This is true because the gas, contacting the coke substantially at its hottest point, lowers its temperature much more rapidly than does a gas flow rising in countercurrent to the coke charge so as to undergo considerable heating before reaching the top of the duct.

The high-temperature reaction zone, in which some coke is liable to be burned off, is thereby considerably narrowed so that losses are minimized. Comparison with known installations operating with counterflowing inert gas has shown that the quenching of coke with a codirectional flow of wet gas according to this feature of our invention results in a coke loss of about 1%, as against approximately 0.5% in the conventional case, which is a small price to pay for this simplified mode of operation.

Surprisingly, we have also determined that the rate of cooling in the upper compartment can be intensified without a significant increase in coke loss by intermittently sprinkling the descending charge with a fine spray of water in the upper compartment. The periodic interruption of the spray is designed to prevent a drenching of the slowly moving coke mass and the optimum amount of water introduced during a given time period will generally depend on such parameters as rate of descent, bult weight and particle size of the coke. In any event, that amount will be only a very small fraction of the quantity of water used during conventional wet quenching; a suitable rate of spray ranges between about 5 and 12 kg of water per ton of coke. By this measure, the upper surface of the coke bed can be quickly cooled down to about 800° C., leaving a shielded core into which the water will barely penetrate so that harmful reactions will be avoided. such a spray, while preferably used in combination with a downward flow of wet cooling gas as described above, could be employed also with a flow of dry gas traversing the upper compartment in a downward or upward direction.

Another important aspect of the invention is the counterflow of the coke and the quenching gas in both the upper and lower compartments.

It has been found to be surprising indeed that, when the initial quenching is not carried out with steam containing cooling gas for a lower portion of the quenching zone as is the case in U.S. Pat. No. 1,854,407, but rather is effected by an independent inert gas in counterflow to the coke or to the lower portion of the zone before this gas traverses the lower portion of the zone, the water gas reaction can be excluded because the temperature of this reaction exists only in the upper portions by the time the coke reaches the lower portion, at which steam may be present, the temperature has been sufficiently lowered to exclude the water gas reaction.

In accordance with another aspect of our invention, a vertical duct used for the quenching of coke pursuant to the aforedescribed process comprises partition means dividing its interior into the upper and lower compartments referred to. A gate formed by the partition means enables the descent of the coke charge while substantially preventing an intermingling of the cooling gases respectively circulating in the two compartments. For this purpose the partition means may be designed as two generally horizontal walls separated from each other by an intervening space and provided with relatively offset apertures constituting the coke gate, namely a first wall forming a lower boundary for the upper compartment and a second wall forming an upper boundary for the lower compartment. The space separating the two walls acts as a buffer zone between the compartments; in cases where it is particularly important to minimize the mixing of the two gas flows, as where an inert gas is used in the upper compartment, this buffer zone can be swept by a scavenger gas preferably traversing it in cross-flow. Advantageously, the relatively offset apertures of the partition-forming walls are a central opening in one wall and a peripheral clearance at the other wall. With a generally cylindrical duct the two walls preferably converge toward each other with relatively inverted conicity, one of them—e.g. the upper one—being a frustocone defining the aforementioned central opening while the other one is a cone spaced from the inner periphery of the duct.

BRIEF DESCRIPTION OF THE DRAWING

The above and other features of our invention will now be described in detail with reference to the accompanying drawing in which.

SPECIFIC DESCRIPTION

Figure 1:
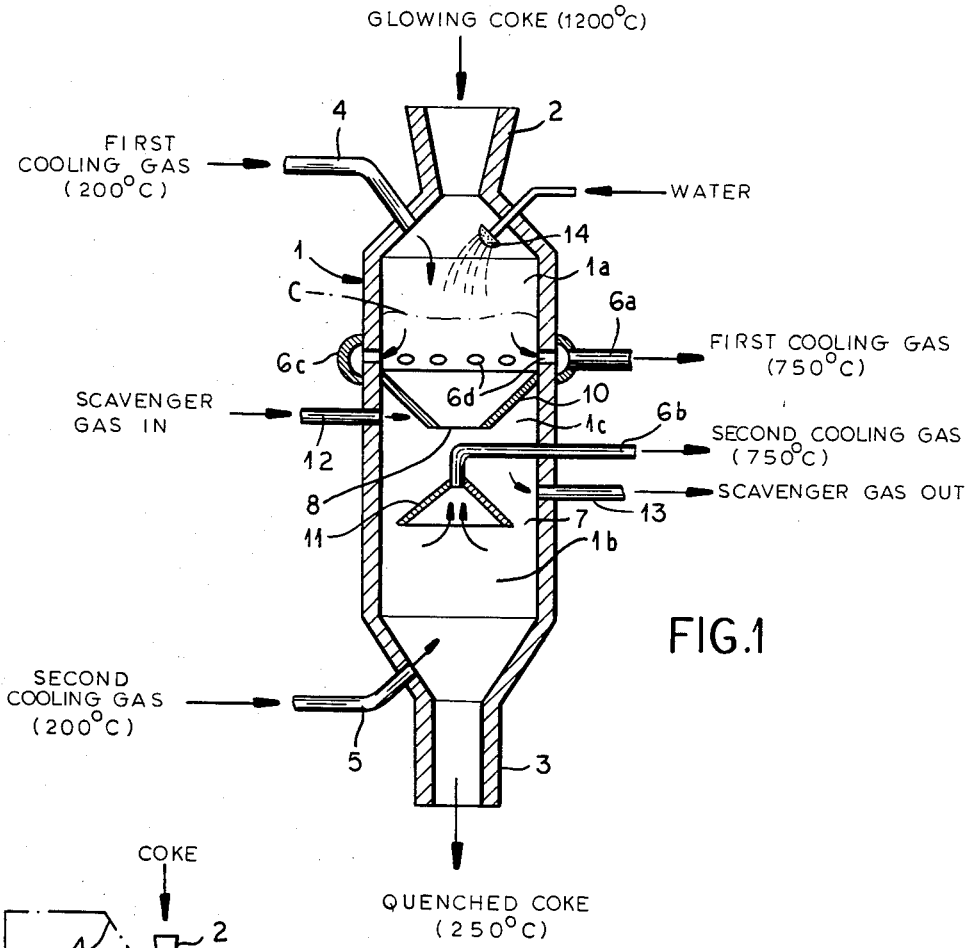
FIG. 1 is a longitudinal sectional view of a horizontally partitioned duct used for the quenching of coke in accordance with our invention.

In FIG. 1 we have shown a quenching duct 1 internally divided into an upper compartment 1*a*, a lower compartment 1*b* and an intervening buffer zone 1*c* bounded by two walls 10 and 11 of relatively inverted conicity converging toward each other. The upper end of the cylindrical duct 1 forms an entrance 2 for glowing coke to be quenched, arriving at a temperature of approximately 1200° C. from a nonillustrated coking chamber included in an associated coke-oven battery; its lower end forms an exit 3 for the discharge of the quenched coke at a temperature of about 250° C.

An inlet 4 near the coke entrance 2 admits a first cooling gas, entering at about 200° C., into the upper compartment 1*a* from which the gas exits at an outlet 6*a*—just above the rim of partition 10—with a temperature of approximately 750° C.

Another inlet 5 near the exit end of the duct admits a second cooling gas, also at substantially 200° C., into the lower compartment 1*b* from which it exits—again at about 750° C.—via an outlet 6*b* extending from the vertex of the conical partition 11. The latter partition is spaced from the inner duct wall by an annular clearance 7 forming part of a coke gate which also includes a central opening 8 at the minor base of the frustoconical partition 10; thus, the upper partition 10 acts as a funnel directing the coke onto a deflector represented by the lower partition 11. Outlet 6*a* is seen to extend from an annular channel 6*c* which encircles the duct 1 and communicates with compartment 1*a* by way of a number of peripheral apertures 6*d*.

A low-temperature and/or relatively inert scavenger gas is admitted into zone 1*c* via an additional inlet 12, exiting from it at an additional outlet 13. Also shown in FIG. 1 is a sprinkler 14, representative of a peripheral array of such sprinklers, through which water is intermittently introduced in the form of a fine spray into the upper compartment 1*a* for a forced cooling of the upper surface of a charge of glowing coke, schematically indicated at C, which slowly descends within the duct 1 and is replenished from time to time with fresh coke pushed out from one of the coking chambers of the associated coke-oven battery.

As will be apparent from the preceding description, the cooling gases entering at inlets 4 and 5 could be identical or different; in either case, however, the gas admitted into inlet 5 via compartment 1*b* is assumed to carry water vapor entrained from a coal-drying oven as described hereinafter with reference to FIG. 3.

Figure 2:
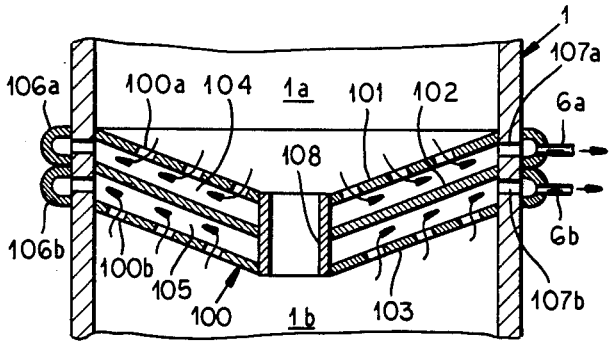
FIG. 2 is a fragmentary sectional view, drawn to a larger scale, of part of a quenching duct provided with a modified partition.

FIG. 2 shows a modified partition 100 forming the lower boundary of the upper compartment 1*a* of duct 1, this partition being constituted by three downwardly converging frustoconical walls 101, 102 and 103 separated from one another by annular clearances 104 and 105. These clearances communicate by way of apertures 100*a* in wall 101 with the upper compartment 1*a* and by way of apertures 100*b* in wall 103 with the lower compartment 1*b* thereof; they further open via ports 107*a* and 107*b* in the peripheral duct wall into annular channels 106*a* and 106*b* to which the outlets 6*a* and 6*b* are respectively connected. A central tube 108 forms a passage for the descending coke which, as in FIG. 1, may be deflected by a conical lower partition into a peripheral gap offset from that passage. Where the separation of the two gas flows is less critical, however, that lower partition could be omitted so that tube 108 alone acts as the coke gate. It will also be apparent that the channeling of the two gas flows to outlets 6*a* and 6*b* could be accomplished by a similar three-part construction of the lower partition 11 of FIG. 1, with or without the corresponding upper partition 10.

Figure 3:
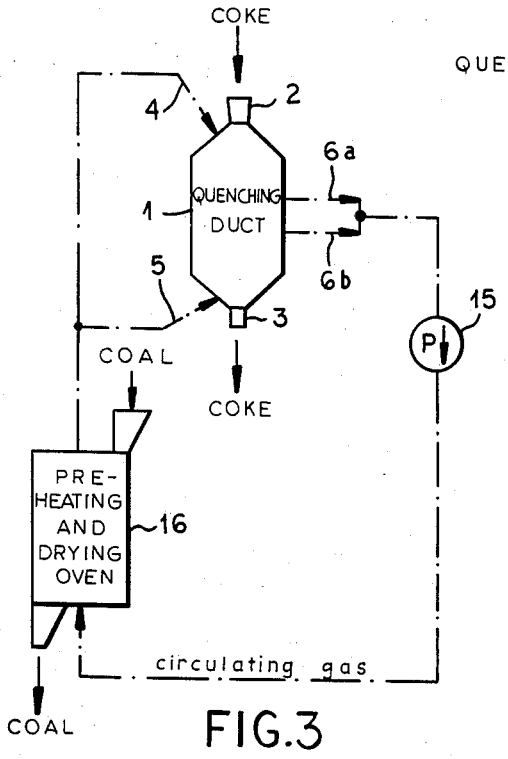
FIG. 3 is a diagrammatic overall view of a system for carrying out the process according to our invention.

Reference will now be made to FIG. 3 showing the quenching duct 1 of FIG. 1 with its gas inlets 4, 5 and its gas outlets 6*a*, 6*b* connected in a closed circuit in which a gas is driven by a pump 15 through a preheating and drying apparatus or stage 16 for "green" cola to be charged into one of the associated coking chambers, the wet gas rising from that oven being then fed in parallel to the inlets 4 and 5 of the quenching duct whose outlets 6*a* and 6*b* have been interconnected. Thus, the circulating gas enters the preheating stage 16 at approximately 750° C. and leaves it at approximately 200° C. after picking up stream from the coal bed in that oven. The moisture content of the circulating gas entering the lower duct compartment 1*b* (FIG. 1) is not harmful, in view of the relatively low temperatures of the coke encountered there, and the further cooling of the coke in that compartment by the counterflowing fluid is thermally very effective. As explained above, the admission of the wet gas into the upper duct compartment is also economically justified since the codirectional flow minimizes the height of the high-temperature zone in which destructive reactions can occur.

Figure 3A:
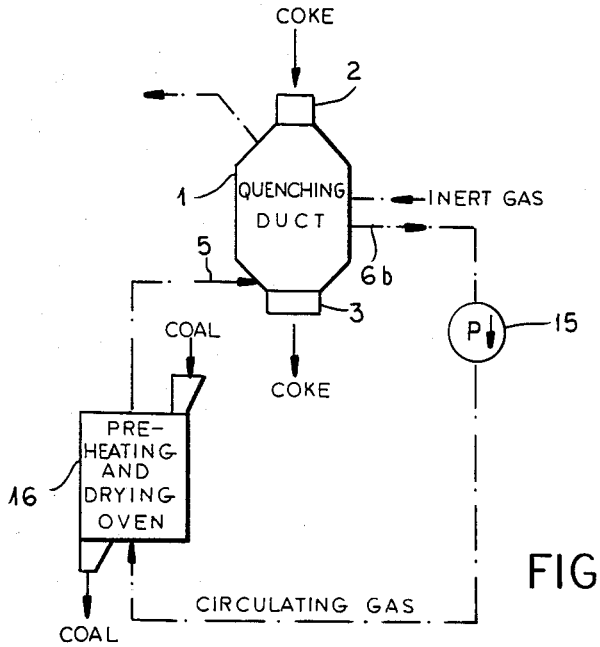
FIGS. 3*a* and 3*b* are diagrams showing alternatives to the process represented in FIG. 3 but also in accordance with the invention.
Figure 3B:
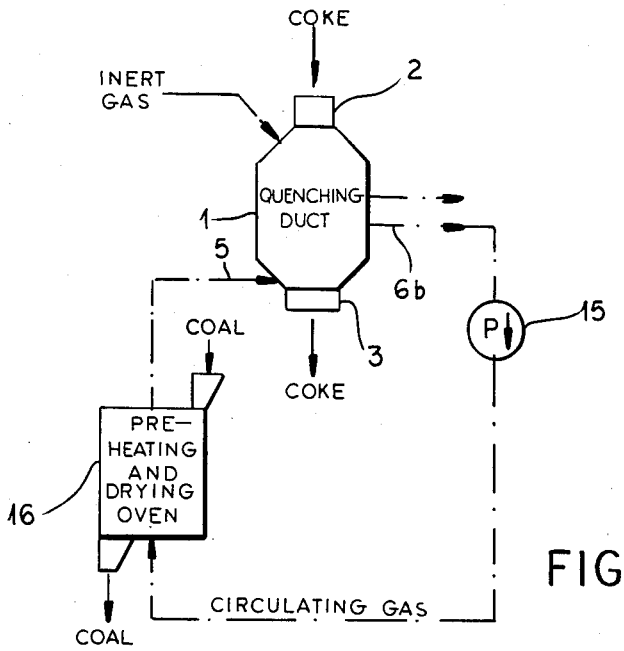

In accordance with the broader aspects of our invention, however, the system of FIG. 3 can be modified by disconnecting the upper inlet 4 of duct 1 from the outlet port of preheating stage 16 and separating the upper outlet 6*a* of that duct from the lower outlet 6*b* so that a different gas can be circulated through the upper compartment 1*a* of FIG. 1 (see FIG. 3*b*). It will also be apparent that the gas exiting from the upper outlet 6*a*, if not employed for the thermal pretreatment of coal, can be utilized for other purposes such as the generation of steam, for example. Another alternative within the invention is shown in FIG. 3*a* wherein a counterflow of the inert gas in the upper portion of the quenching zone and the coke is provided.

Figure 4:
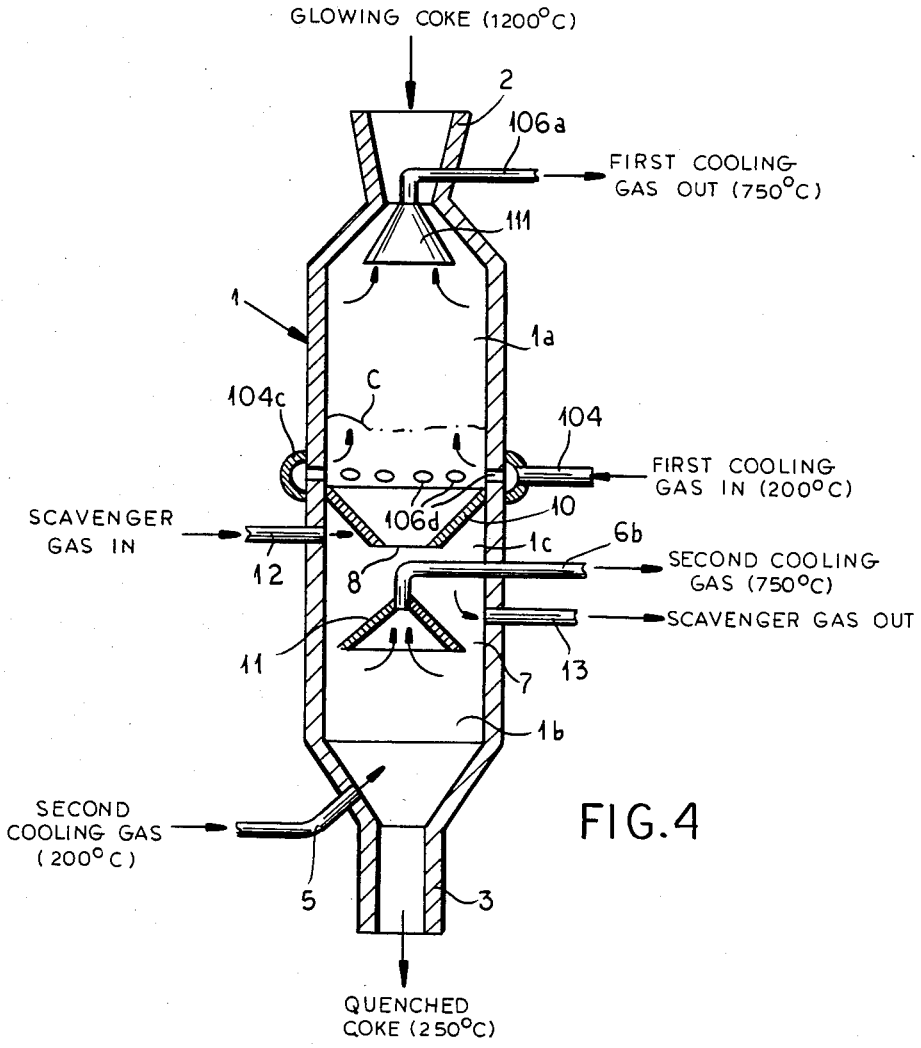
FIG. 4 is a view similar to FIG. 1 of another embodiment of the invention.

FIG. 4 shows an embodiment wherein the flow of cooling gas in the upper compartment is in counterflow to the passage of the coke therethrough. Here a collecting funnel 111 discharges the rising cooling gas via a pipe 106*a* while a pipe 104 delivers the first cooling gas to the manifold 104*c* for distribution to the holes 106*d*. Otherwise this embodiment operates in the manner described, except that a water spray is not used.

We claim:

1. A process for quenching glowing coke in a plant in which the coke to be quenched is discharged from a coking chamber to be recharged with coal dried in a drying and preheating stage by direct contact with a hot gas picking up water vapor from the coal, comprising the steps of:

(a) feeding the glowing coke from above into a quenching duct divided into an upper and a lower compartment from which quenched coke is extracted at the bottom whereby said coke descends in said compartments and from said upper compartment to said lower compartment;

(b) passing a first flow of a cooling gas which is inert with respect to said descending coke in countercurrent to said coke through said upper compartment for reducing the coke temperature therein to a range between substantially 700° and 800° C. by direct contact of said cooling gas with said coke and withdrawing the first flow of gas from a lower portion of said upper compartment;

(c) passing a second flow of a cooling gas which is said hot gas obtained from said drying and preheating stage and containing water vapor after traversing said drying and preheating stage through said lower compartment in countercurrent to the descending coke for further reducing the temperature thereof to a level below substantially 300° C. by direct contact of said second flow of said cooling gas with said coke;

(d) laterally withdrawing said second flow of cooling gas, heated by said direct contact with the descending coke in said lower compartment at an upper portion of said lower compartment and recirculating the withdrawn second flow of gas through said drying and preheating stage as said hot gas and then back to said duct; and (e) maintaining separation of said first and second flows of cooling gas from one another at a location corresponding substantially to a lower portion of said upper compartment and an upper portion of said lower compartment while permitting said coke to pass therebetween.

2. A process for quenching glowing coke in a plant in which the coke to be quenched is discharged from a coking chamber to be recharged with coal dried in a drying and preheating stage by direct contact with a hot gas picking up water vapor from the coal, comprising the steps of:

(a) feeding ther glowing coke from above into a quenching duct divided into an upper and a lower compartment from which quenched coke is extracted at the bottom whereby said coke descends in said compartments and from said upper compartment to said lower compartment;

(b) passing a first flow of a cooling gas which is said hot gas obtained from said drying and preheating stage and containing water vapor after traversing said drying and preheating stage in codirectional flow to said coke through said upper compartment for reducing the coke temperature therein to a range between substantially 700° and 800° by direct contact of said cooling gas with said coke and withdrawing the first flow of gas from a lower portion of said upper compartment;

(c) passing a second flow of a cooling gas which is said hot gas obtained from said drying and preheating stage and containing water vapor after traversing and drying and preheating stage through said lower compartment in countercurrent to the descending coke for further reducing the temperature thereof to a level below substantially 300° C. by direct contact of said second flow of said cooling gas; and (d) recirculating said first and second flow of cooling gases, heated by said direct contacts with the descending coke in said upper and said lower compartments commonly through said drying and preheating stage as said hot gas and then back to said duct, with the first and second flows of cooling gases beig withdrawn at said lower portion of said upper and an upper portion of said lower compartments respectively for the recirculation.

3. A process as defined in claim 2 wherein the coke is intermittently sprinkled with a fine water spray in said upper compartment in an amount between 5 and 12 kg of water per ton of coke.

4. A process for quenching glowing coke in a plant in which the coke to be quenched is discharged from a coking chamber to be recharged with coal dried in a drying and preheating stage by direct contact with a hot gas picking up water vapor from the coal, comprising the steps of:

(a) feeding the glowing coke from above into a quenching duct divided into an upper and a lower compartment from which quenched coke is extracted at the bottom whereby said coke descends in said compartments and from said upper compartment to said lower compartment;

(b) passing a first flow of a cooling gas which is inert with respect to said descending coke in codirectional flow to said coke through said upper compartment for reducing the coke temperature therein to a range between substantially 700° and 800° C. by direct contact of said cooling gas with said coke and withdrawing the first flow of gas from a lower portion of said upper compartment;

(c) passing a second flow of a cooling gas which is said hot gas obtained from said drying and preheating stage and containing water vapor after traversing said drying and preheating stage through said lower compartment in countercurrent to the descending coke for further reducng the temperature thereof to a level below substantially 300° C. by direct contact of said second flow of said cooling gas with said coke;

(d) laterally withdrawing said second flow of cooling gas, heated by said direct contact with the descending coke in said lower compartment at an upper portion of said lower compartment and recirculating the withdrawn second flow of gas through said drying and preheating stage as said hot gas and then back to said duct; and (e) maintaining separation of said first and second flows of cooling gas from one another at a location corresponding substantially to a lower portion of said upper compartment and an upper portion of said lower compartment while permitting said coke to pass therebetween.

* * * * *